United States Patent [19]

Kubis et al.

[11] Patent Number: 4,848,060

[45] Date of Patent: Jul. 18, 1989

[54] CARTON LID TRANSFER ASSEMBLY

[75] Inventors: Charles S. Kubis, Palos Heights; John Walter, Evergreen Park, both of Ill.

[73] Assignee: Continental Can Company, Inc., Norwalk, Conn.

[21] Appl. No.: 207,502

[22] Filed: Jun. 16, 1988

[51] Int. Cl.[4] ..... B65B 7/28; B67B 5/02

[52] U.S. Cl. ..... 53/308; 53/307

[58] Field of Search ..... 53/307, 308, 306, 202; 414/744.6

[56] References Cited

U.S. PATENT DOCUMENTS

| | | | |
|---|---|---|---|
| 1,470,348 | 10/1923 | Clark | 53/308 X |
| 1,654,091 | 12/1927 | Peiler | 414/744.6 X |
| 1,754,461 | 4/1930 | Cundall | 53/308 X |
| 3,714,755 | 2/1973 | Phalin et al. | 53/308 X |
| 3,820,305 | 6/1974 | Van Der Meer | 53/308 |
| 3,939,625 | 2/1976 | Remele et al. | 53/307 X |
| 4,674,935 | 6/1987 | Feliks et al. | 53/307 X |

*Primary Examiner*—Horace M. Culver

*Attorney, Agent, or Firm*—Charles E. Brown; Paul Shapiro; Charles A. Brown

[57] ABSTRACT

This relates to a mechanism for transferring carton lids from a hopper or magazine to a carton closing machine and more particularly to a sealing head of such a machine. The carton closing machine has a plurality of sealing heads each carried at a work station and mounted for rotation with the machine. The carton lid transfer mechanism includes a picker for pulling a lower most lid from the hopper and thus assisting in the transfer from the hopper to a ferris wheel assembly in sequence carton lids. The ferris wheel assembly then deposits each picked up lid on to a lid carrier of a merry-go-round assembly. The merry-go-round assembly then transfers each lid to the respective sealing head of the carton closing machine. The merry-go-round assembly is provided with control plates which serve to orient lid carriers both at the time a lid is being transferred thereto and at the time a lid is being transferred to the carton closing machine so that the lid carrier is in proper alignment for receiving a lid and furthermore in proper alignment for transferring a lid to a sealing head.

20 Claims, 5 Drawing Sheets

FIG. 4
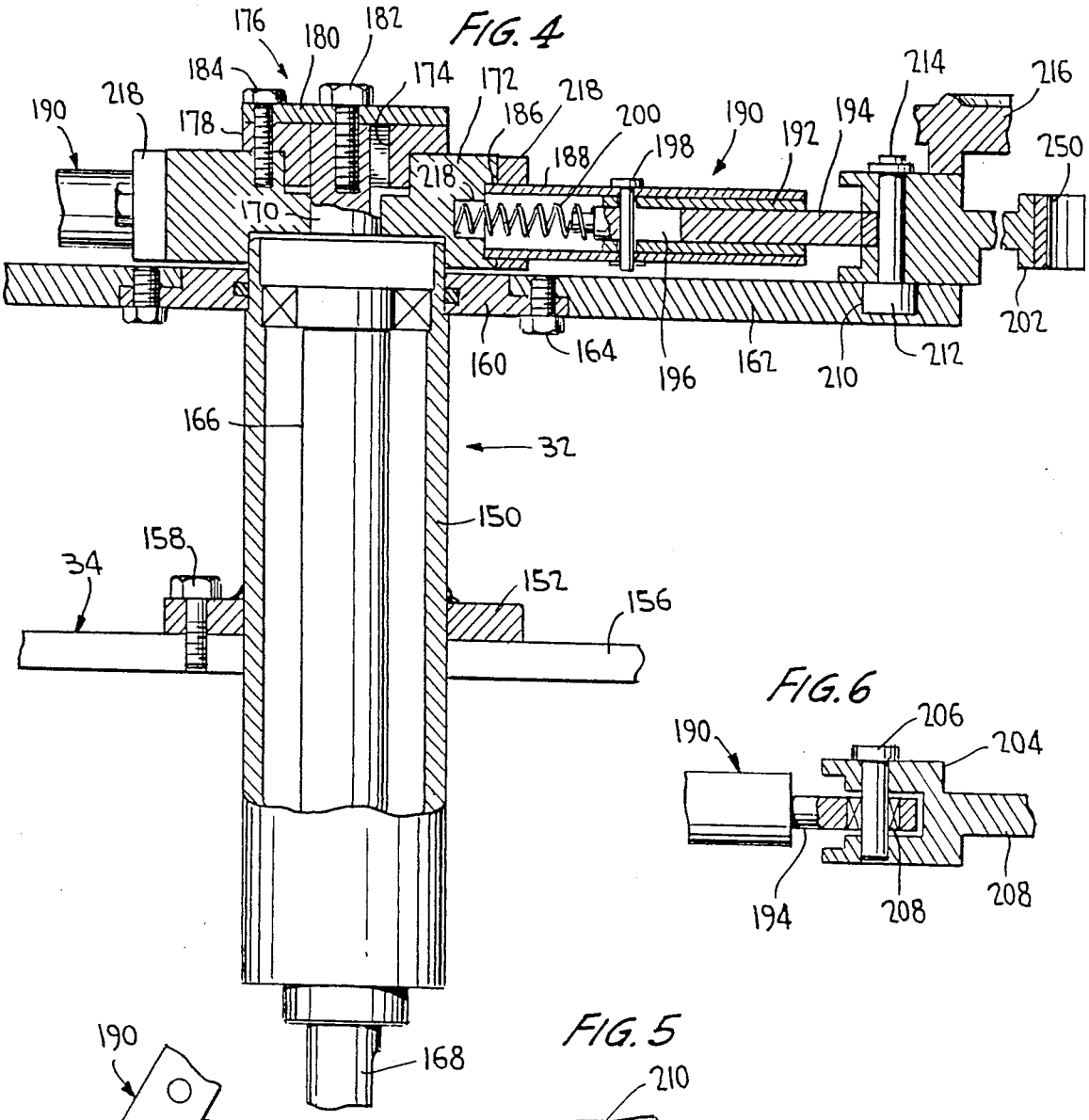
FIG. 6
FIG. 5
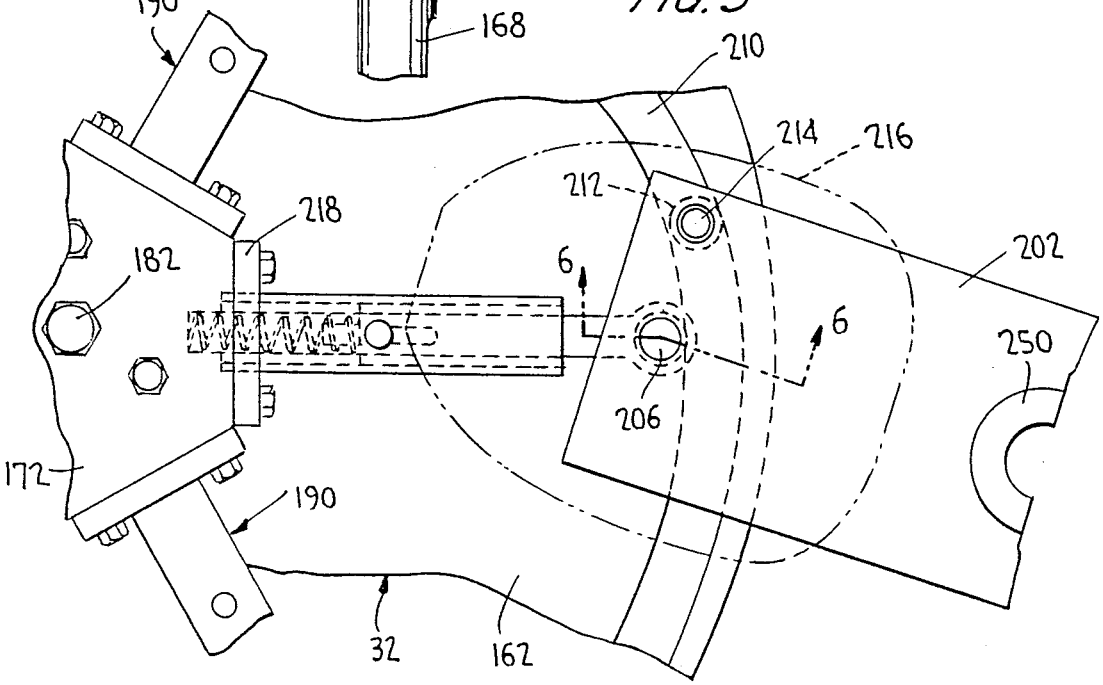

CARTON LID TRANSFER ASSEMBLY

This invention relates in general to new and useful improvements in transfer assemblies, and more particularly to a carton lid transfer assembly for removing carton lids from a magazine and sequentially presenting such carton lids to individual work stations of a rotating multiple work station carton closing machine.

In accordance with this invention, carton lids are removed from an end or bottom of a magazine by way of a pivotally mounted reciprocating picker for immediate transfer to a suction head of a multiple station ferris wheel type transfer mechanism which, in turn, seats each carton lid in a carrier of a plural carrier merry-go-round assembly which, in turn, transfers each carton lid to a position for pickup by a sealing head of a carton closing machine.

The picker includes a pivotally mounted arm which carries a suction head and the arm is oscillated by means of an eccentric carried by a constantly rotating shaft. Further, the shaft carries a rotary valve for connecting the suction head to a vacuum source and a pressure source in timed relation to the presentation of the suction head to a magazine for carton lids.

The ferris wheel assembly includes a plurality of pairs of arms each of which carries at the end thereof a suction head. The arms of each pair are spaced apart and positioning the suction heads carried by the arms on opposite sides of the suction head of the picker so as to have full control over a carton lid being transferred.

The ferris wheel assembly includes a main shaft for rotating the arms thereof and this shaft carries a rotary valve for selectively applying a vacuum to the suction heads of the ferris wheel assembly.

The merry-go-round assembly includes a plurality of carriers which are mounted on control plates which, in turn, are carried by radiating arms. Each control plate is pivotally connected to a respective one of the arms and has a cam follower which rides in a cam track. The arms are resiliently extensible so as to apply a radially outwardly directed pressure on a respective control plate which, in conjunction with the cam follower carried by the control plate in engagement with the cam track, will orient the respective control plate. By orienting each control plate, the carrier carried by each control plate is properly oriented for receiving a carton lid from the ferris wheel assembly and for presenting the carton lid to a carton closing machine work station.

Further, each control plate is provided with a notch at a radially outer end thereof for engagement with a pin for a respective work station of the carton closing machine. The pin engages in the notch of the respective control plate and as the control plate and the carton closing machine rotates, the pin serves to pivot the control plate and thus maintain a carton lid to be transferred in alignment with a sealing head of the carton closing machine.

With the above and other objects in view that will hereinafter appear, the nature of the invention will be more clearly understood by reference to the following detailed description, the appended claims and the several views illustrated in the accompanying drawings.

IN THE DRAWINGS

FIG. 4 is an enlarged vertical sectional view taken generally along the line 4—4 of FIG. 3 and shows the general details of a merry-go-round transfer assembly.

FIG. 5 is an enlarged fragmentary plan view showing the details of one station of the merry-go-round assembly.

FIG. 6 is an enlarged fragmentary vertical sectional view taken generally along the line 6—6 of FIG. 5 and shows the pivotal connection between a control plate and an associated arm of a station of the merry-go-round assembly.

Figure 1:
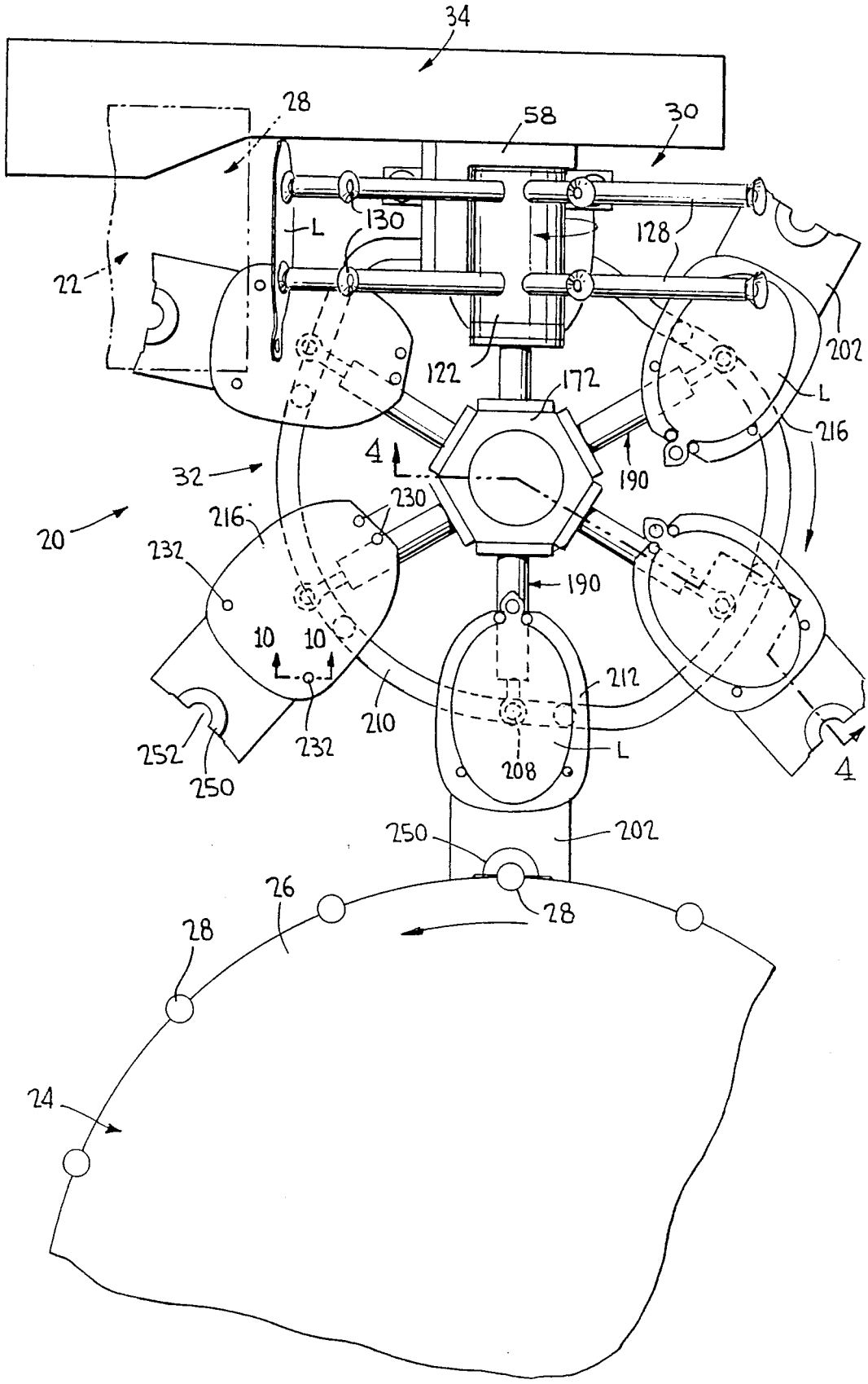
FIG. 1 is a schematic top plan view of the carton lid transfer assembly and shows the relationship of the various components thereof including the relationship thereof to the carton closing machine.
Figure 3:
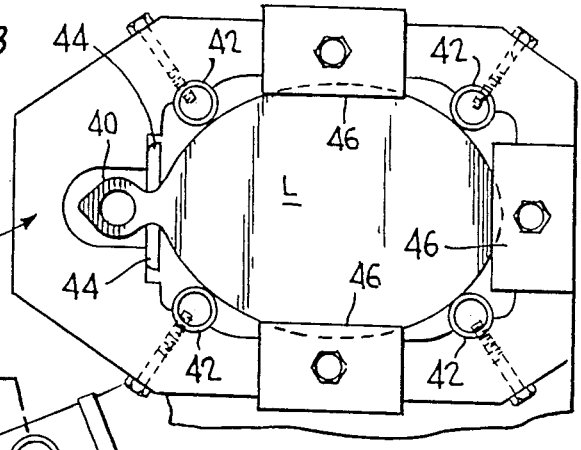
FIG. 3 is an end elevational view of the magazine showing generally the outline of a carton lid and the manner in which it is retained by the magazine.

Reference is now made to FIG. 1 wherein there is illustrated a transfer assembly in accordance with this invention, the transfer assembly being generally identified by the numeral 20. The transfer assembly 20 is particularly constructed for transferring carton lids from a magazine or hopper 22 to a carton closure machine generally identified by the numeral 24. Only those portions of the carton closing machine having to do with the transfer of carton lids thereto are illustrated. Most particularly, there is illustrated a support plate 26 which is mounted for rotation on a main shaft of the machine and which support plate carries a plurality of work stations. Each work station will include a sealing head (not shown) which is vertically movable in timed relation to the rotation of the support plate 24 for picking up a carton lid and applying the same to a carton. At each of the work stations there is carried by the support plate 26 an alignment pin 28 which cooperates with the transfer assembly.

The transfer assembly includes three basic components. These include a picker 28 for picking a lowermost carton lid from the hopper 22. Then there is a ferris wheel assembly 30 which rotates about a horizontal axis and receives carton lids from the picker 28. Finally, there is a merry-go-round assembly 32 having carriers which receive carton lids from the ferris wheel assembly and present the same to the carton closing machine 24 for pickup by sealing heads of the carton closing machine.

There is provided a supporting frame 34 which carries the various components of the transfer assembly including a hopper or magazine 36. The hopper 36 is of a conventional construction and is particularly adapted to dispense carton lids L which are generally oval in shape and which have a projecting pull tab 40. The lids L are positioned within the hopper 36 by way of guide rods 42 with the carton lids L being urged towards the bottom of the hopper 36 in a conventional manner. The pull tabs 40 of the lids are retained in alignment with one another by way of bars 44 and the lowermost lid is retained within the hopper 36 by way of plates 46 which underlie the lowermost carton lid L to a very limited extent so that the carton lids L may be pulled therefrom.

Figure 2:
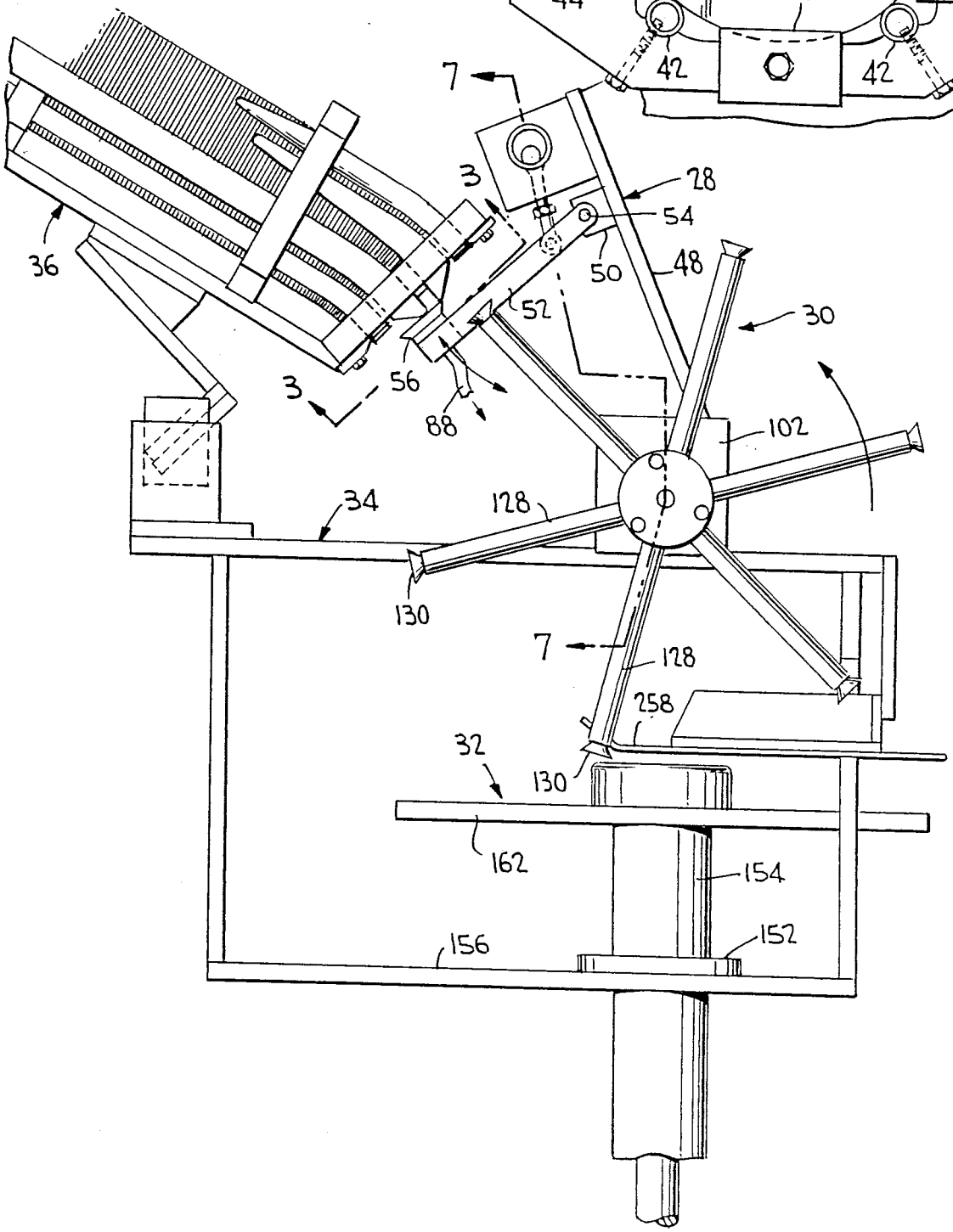
FIG. 2 is a schematic side elevational view of the carton lid transfer assembly and shows primarily the relationship of the lid magazine, a picker and a ferris wheel transfer assembly.
Figure 7:
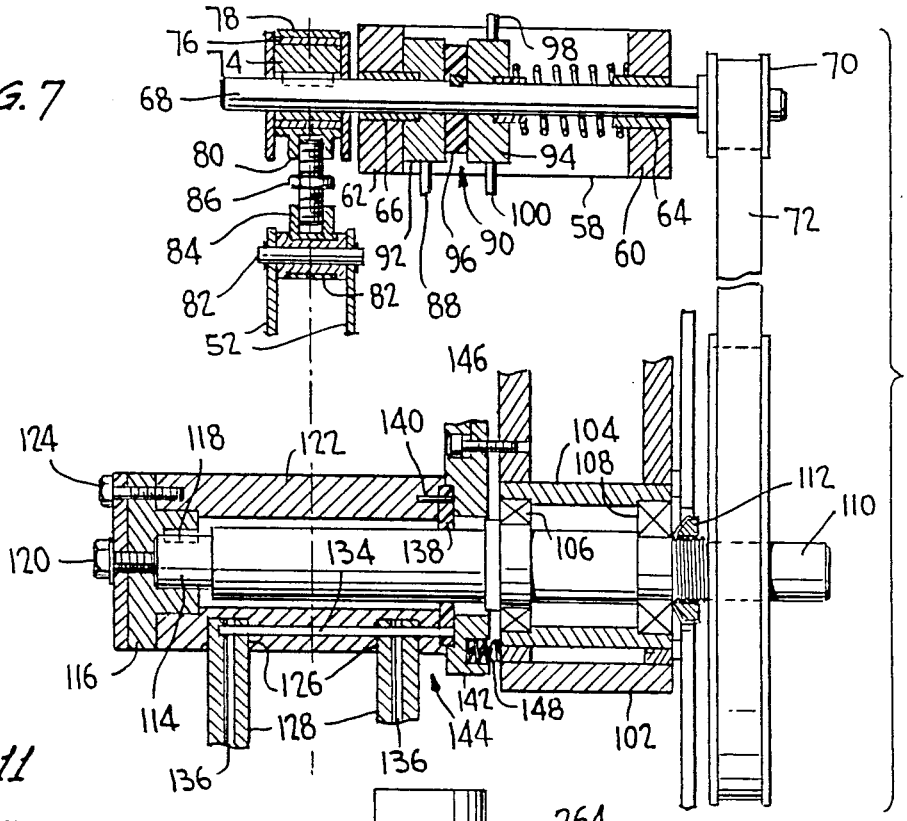
FIG. 7 is an enlarged fragmentary vertical sectional view taken generally along the line 7—7 of FIG. 2 and shows generally the details of both the picker and the ferris wheel assembly.

Referring now to FIGS. 2 and 7, it will be seen that the details of the picker 28 are best shown therein. The picker 28 is carried by a support arm 48 of the frame 34 as is best shown in FIG. 2. The support arm 48, adjacent the upper end thereof, is provided with a bracket 50 from which a pair of parallel arms 52 extend with the arms 52 being pivotally mounted on the bracket 50 by way of a pivot pin 54. The arms 52 carry at their outer end a suction head 56.

It is to be understood that the suction head 56 will oscillate towards and away from the lower end of the hopper 36 so as to draw upon each cycle of movement thereof from the hopper 36 a lowermost lid L. In order to effect this movement, there is provided an operating mechanism which is mounted at the upper end of the support arm 48. This operating mechanism includes a housing 58 which has mounted in opposite ends thereof bearing blocks 60, 62 which carry elongated sleeve bearings 64, 66. A shaft 68 extends through and is rotatably journalled within the housing 58 by way of the sleeve bearings 64, 66. On one end of the shaft 68 there is mounted a drive pully 70 for a belt 72, the manner in which the belt 72 is driven will be described in detail hereinafter. On the opposite end of the shaft 68 there is keyed an eccentric 74 which carries a bearing 76 which, in turn, carries a sleeve 78. The sleeve 78 has welded thereto in radiating relation an internally threaded sleeve 80.

As is best shown in FIG. 7, a pin and sleeve arrangement 82 extends between the arms 52 in spaced relation to the pivot pin 54. The sleeve of the arrangement 82 carries an internally threaded radially extending sleeve 84 which is aligned with the sleeve 80. A turnbuckle screw 86 has the opposite ends thereof threaded in the sleeves 80, 84. The turnbuckle screw 86 has opposite ends thereof reversely threaded so that the turnbuckle screw 86, when rotated, may shorten or lengthen the link between the sleeve 78 and the pin and sleeve assembly 82 and, thereby, adjust the position of the suction head 86 relative to the lower most ends of the hopper 36.

It will be understood that for each revolution of the shaft 68, there will be a one oscillation of the suction head 66.

As is shown in FIG. 2, the suction head 56 has connected thereto a fluid line 88. When the suction head is presented to pick up a lid L, a vacuum will be drawn in the suction head so as to draw the lid thereunto so that as the suction head 56 moves away from the hopper 36, the lowermost lid L will be drawn from the hopper. When the suction head 56 is ready to discharge a removed lid to the ferris wheel arrangement 30, the vacuum will be discontinued and air under pressure directed into the suction head 56 to discharge the removed lid L therefrom. To this end there is carried by the housing 58 within the housing a rotary valve generally identified by the numeral 90. The rotary valve 90 includes two manifold plates 92, 94 disposed in opposed relation and separated by a seal plate 96 which functions as a distribution plate. The manifold plates 92, 94 are fixed against rotation within the housing while the seal 96 is keyed onto the shaft 68 for rotation therewith. The manifold plate 94 has coupled thereto a vacuum line 98 and a pressure line 100 while the manifold plate 92 has coupled thereto the fluid line 88. It is to be understood that the seal 68 will have ports therein which selectively join the vacuum and pressure lines to the fluid line 88 in timed relation as the shaft 68 rotates.

The ferris wheel arrangement 30 will next be described. As is best shown in FIGS. 2 and 7, it will be seen that the frame 34 includes a housing 102. The housing 102 carries a sleeve 104 which has mounted in the opposite ends thereof bearings 106, 108 which support a shaft 110 for rotation. The shaft 110 has a shoulder which abuts against the bearing 106 and carries a nut 112 which bears against the bearing 108 to axially position the shaft 110. It will be noted that the shaft 110 extends axially considerably beyond the housing 102. The projecting portion of the shaft 110 has a reduced diameter end portion 114 on which there is fixedly mounted an end cap 116 by way of a key 118 and a bolt 120, the bolt 120 being threaded axially into the end of the shaft 110. A tubular member 122 is telescoped over the projecting end portion of the shaft 110 and is carried by the end cap 116 by way of a plurality of axially extending bolts 124. The tubular member 122 is provided at circumferentially spaced intervals with pairs of radial bores 126 which only extend partially through the wall thickness of the tubular member. Into each bore 126 there is press fitted a radiating arm 128. As is best shown in FIG. 2 there are six pairs of the arms 128 although the number of pairs of arms 128 may vary. Each arm 128 carries at its outer end a suction head 130. It is to be noted in FIG. 2 that each pair of suction heads 130 are disposed generally on opposite sides of the suction head 56 to pick up a lid L therefrom.

Referring once again to FIG. 7, it will be seen that the shaft 110 is provided with a belt pulley 132 which is aligned with the belt pulley 70 and over which the belt 72 is entrained to be driven. It is to be understood that the diameter of the belt pulley 136 will be six times the diameter of the belt pulley 70 in view of the fact that there are six pairs of arms 128 so that the suction head 56 makes one oscillation in timed relation to the movement of each pair of suction heads 130 into cooperating relation therewith.

In order that a vacuum may be presented to each suction head 130 in timed relation to the rotation thereof, it will be seen that the tubular member 122 functions as a manifold and has an axial bore 134 extending therethrough and also into the ends of the arms 128 which are seated in the tubular member 122. Each arm 128, in turn, has an axial bore 136 which opens into the bore 134. The bore 134 opens through the right end of the tubular member 122 into a seal plate 138 which is pinned onto the tubular member 122 by one of a plurality of circumferentially spaced pins 140 for rotation with the tubular member 122. There is a fixed manifold plate 142 which opposes the opposite face of the seal plate 138 in sealed relation. Thus the tubular member 122, the seal plate 138 and the manifold plat 142 form a rotary valve generally identified by the numeral 144.

The manifold plate 142 is fixed against rotation by a plurality of shoulder bolts 146 which are threaded into the housing 102 and limits axial movement of the manifold plate 142 away from the housing 102. On the other hand, circumferentially spaced spring 68 extend between the manifold plate 142 and the housing 102 to tightly clamp the manifold plate 142 against the seal plate 138. It is to be understood that a vacuum line will be connected to the manifold plate 142 and that the seal plate 138 will have a suitable groove in the face thereof for supplying a vacuum to each vacuum head 130 when it reaches a position approaching cooperation with the suction head 56 and that the vacuum will remain in effect until the respective suction head 130 reaches a point where it is ready to discharge a lid L on to the merry-go-round 32.

Reference is now made to FIGS. 4 through 10 wherein the specific details of the merry-go-round assembly 32 are illustrated. The merry-go-round assembly 32 includes an upstanding tubular housing 150 which is provided intermediate its ends with an annular mounting flange 152. The housing 150 passes through an opening 154 in a frame member 156 of the frame 34 with the mounting flange 152 being seated on the frame member 156 and secured thereto by suitable bolts 158.

The tubular housing 150 is provided adjacent the upper end thereof with a second mounting flange 160. A cam plate 162 is mounted on the flange 160 by way of bolts 164.

A shaft 166 is mounted within the housing 150 for rotation and includes a lower drive end 168 and a reduced diameter upper end portion 170. There is mounted on the upper end portion 170 above the housing 150 a mounting hub 172 which is connected to the shaft end portion 170 by means of a key 174. The hub 172 is carried by an end cap 176 which includes a further hub 178 which is keyed to the shaft portion 170 by the key 174, and an end plate 180. The end plate 180 is connected to the shaft 166 by a bolt 182 which extends into the extreme end of the shaft 166. Other bolts 184 pass through the end plates 180 and hub 178 and are threaded into the hub 172 to connect the hub 172 to the end cap 176.

The hub 172 is provided with a plurality of stepped bores 186, the number of bores 186 corresponding to the number of pairs of arms 128 of the ferris wheel unit 30. In this instance, the bores 186 are six in number.

Each bore 186 has pressed thereinto one end of a tubular arm member 188 which extends radially from the hub 172. Each tubular arm member 188 forms part of an arm 190 which also includes a bearing bushing 192 which is telescoped in the outer portion of the arm member 188. Further, a solid arm member 194 is slidably mounted within the bushing 192 and has an end portion projecting beyond the arm portion 188. An inner end portion of the arm 194 is provided with a through slot 196 through which a retaining pin 198 carried by the arm member 188 passes. The pin 198, in conjunction with the slot 196, limits radial movement of the arm member 194 by a compression spring 200 which bears against the inner end of the arm member 194.

Referring now specifically to FIGS. 5 and 6, it will be seen that there is carried by an outer end of the arm member 194 a control plate 202 which is generally rectangular in outline. The control plate 202 has an inner edge portion which is thickened and wherein a central part of that edge portion is bifurcated as at 204. The bifurcated part of the control plate 202 is telescoped over the other end of the arm member 194 and is pivotally connected thereto by means of a vertical pin 206. The pin 206 passes through a bushing 208 carried by the arm member 194.

Referring now to FIGS. 4 and 5 in particular, it will be seen that the cam plate 162 has formed in the upper surface thereof adjacent the periphery thereof an upwardly opening cam track 210. Each control plate 202 carries a cam follower 212 which is seated in the cam track 210. Each cam follower 212 is carried by a shaft 214 which extends through the thick portion of the respective control plate 202. It is to be understood that as the cam track varies in distance from the center of the shaft 166, the spring loaded arm 190 will vary the location of the pivot pin 206 relative to the associated cam follower 212 and thus vary orientation of the control 202 relative to the arm assembly 190.

It is further to be noted that there is carried by the upper surface of the control plate 202 a lid carrier 216. The relative position of a lid carrier 216 with respect to a control plate 206 is best illustrated in phantom lines in FIG. 5.

It is also particularly pointed out at this time that it is extremely important that each lid carrier 216 be particularly oriented at the time a lid L is being transferred thereto and being discharged therefrom. This will be described in more detail hereinafter.

It is further pointed out here that most conveniently, each arm assembly 190 may be carried by a mounting plate 218 which is bolted onto the hub 172 as is best shown in FIG. 4.

Figure 8:
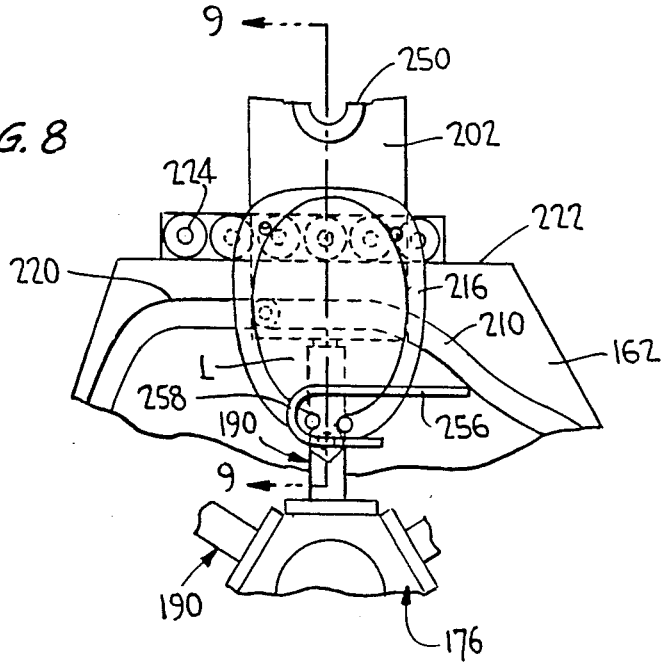
FIG. 8 is an enlarged fragmentary plan view of a work station of the merry-go-round assembly as it is positioned for receiving a carton lid from the ferris wheel assembly.
Figure 9:
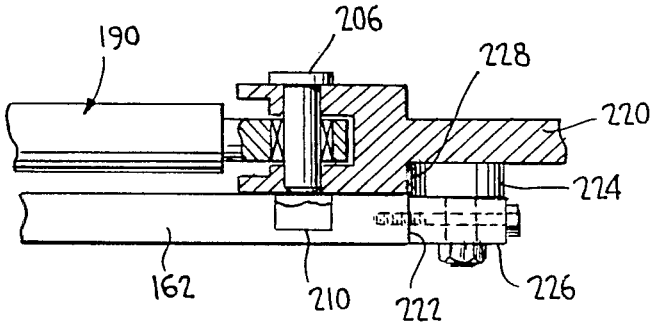
FIG. 9 is an enlarged fragmentary vertical sectional view taken generally along the line 9—9 of FIG. 8 and shows the manner in which a control plate and an associated carton lid carrier are oriented for receiving a carton lid from the ferris wheel assembly.

Referring now to FIGS. 8 and 9, it will be seen that at the time a lid 216 is positioned for receiving a lid L from the ferris wheel assembly 30, the associated control plate 202 should be aligned with the axis of the arm assembly 190 and be retained in that position for a period of time during which the discharge of a lid L takes place. It will thus be seen that in the locale of the lid transfer to the lid carrier 216, the cam track 210 has a straight portion 220. Further, the cam plate 162 has a straight edge 222. It is to be noted that mounted along that straight edge 222 is a series of rollers 224. The rollers 224 are horizontally disposed and are carried by a mounting plate 226 which is secured to the straight edge 222.

Further, it is to be noted that the underside of each control plate 202 adjacent the enlargement thereof is provided with a face 228 which ride on the rollers 224 and assure the straight line movement of the control plate 202 while it is a straight line extension of the respective arm assembly 190. In this manner straight line movement of a lid carrier 216 during the transfer of a lid L thereto is assured.

Figure 10:
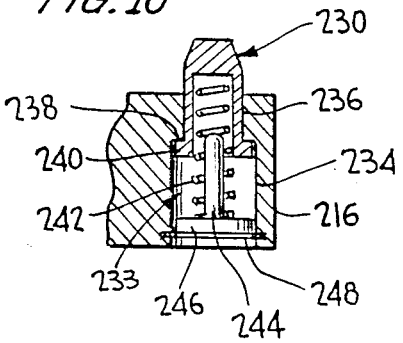
FIG. 10 is an enlarged fragmentary vertical sectional view taken through a carrier of FIG. 1 and shows the details of a resiliently mounted carton lid positioning pin.

In order to locate a lid L on the lid carrier 216, as is best shown in FIG. 1, each lid carrier 216 is provided with a first set of pins 230 for receiving a neck portion of the lid L and a second set of pins 232 which are widely spaced for receiving the base of a lid L. The pins 230 and 232 are identical and the details thereof are best illustrated in FIG. 10. It will be seen that the respective lid carrier 216 has formed therein a through stepped bore 233 including a lower 234 and a reduced diameter upper portion 236 separated by a downwardly facing shoulder 238. The pin 230 has a lower outwardly directed retaining flange 240 which is normally held against the shoulder 238 by a coil spring 242 which extends up into a hollow portion of the pin 230. The lower part of the spring 242 is mounted on a pin 244 which has a base 246 which is seated on a retaining clip 248.

It will be readily apparent that should some foreign object improperly engage a pin 230, the pin will move downwardly into the lid carrier 216 so as to avoid damage. The pin 230 and its assembly may be replaced by removing the clip 248.

Reference is now made once again to FIG. 1 wherein a lid L is in a position for transfer to a work station of the carton closing machine 24. It will be seen that each control plate 202 is provided in the outer end thereof with a hardened insert 250 which defines a semicircular outline notch 252. The notch 252 is of a size to have snugly received therein one of the pins 28 carried by the outer periphery of the rotating support plate 26. This is clearly shown in FIG. 1. When this occurs, it is to be understood that the interlock between a pin 28 and the control plate 202 on the one hand, together with the relationship between the cam follower 212 and the cam track 210 on the other hand as well as the pivotal mounting of the control plate 202 on the arm assembly 190, will result in the lid L to be transferred to the carton closing machine 24 to maintain a position wherein the control plate 202 is in alignment with a radial line passing through the respective pin 28. Thus during the time required to pick up a lid L by a sealing head (not shown) of the carton closing machine 24, perfect alignment of the respective lid with such a sealing head will be maintained automatically.

Although no specific drive means have been illustrated, it is to be understood that conventional drive means will be provided for rotating the shafts 166 so that the outer periphery of each control plate 202 moves at the same peripheral speed as the pins 28. Further, a suitable drive will connect the drive shaft 166 to the drive shaft 110 to move the lid carriers 216 at the same peripheral speed as the suction heads 130.

Figure 11:
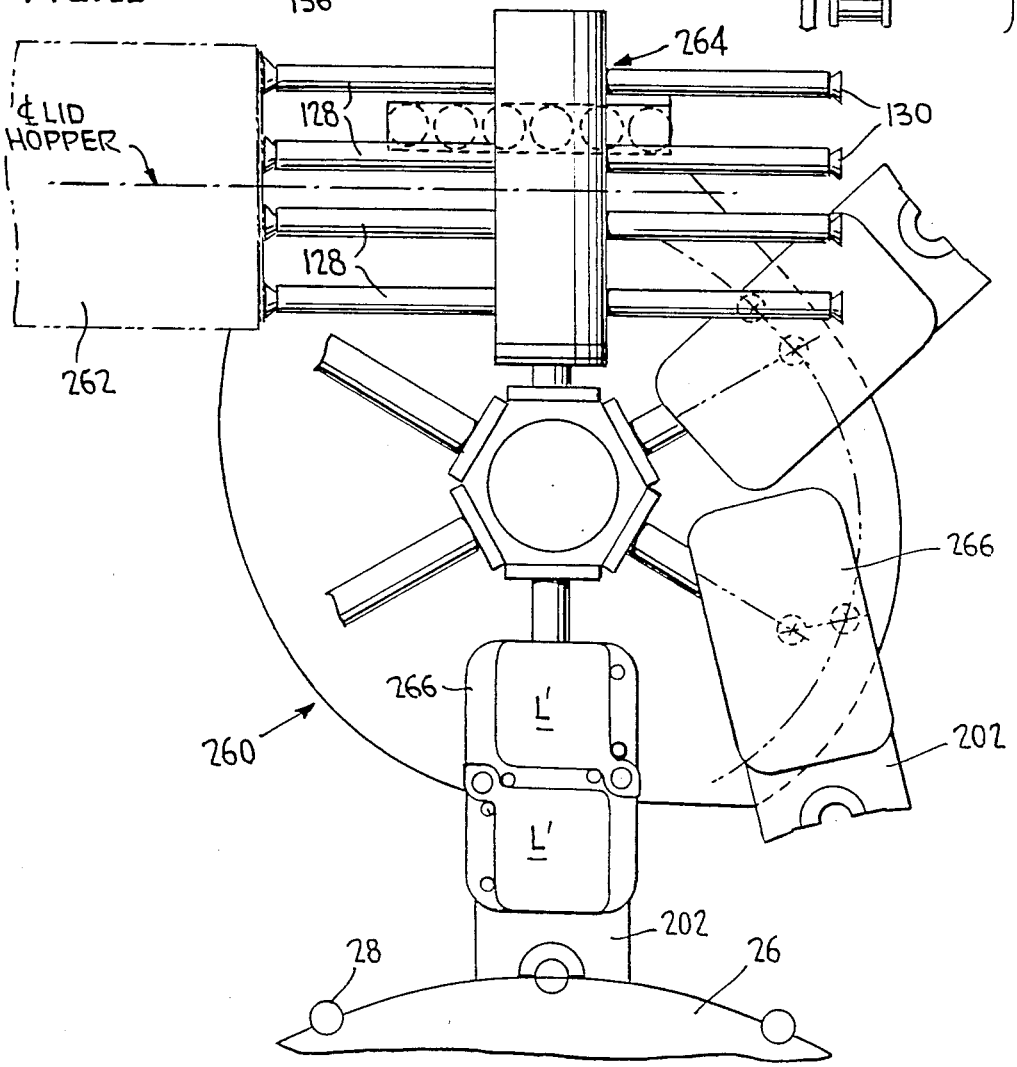
FIG. 11 is a schematic plan view showing a transfer assembly for simultaneously transferring two carton lids.

Reference is now made to FIG. 11 wherein there is schematically illustrated a modified form of lid transfer device generally identified by the numeral 260. The lid transfer device 260 will be utilized in conjunction with a hopper 262 which is configurated to dispense simultaneously two lids L′ as opposed to a single lid L. The picker 28 may be the same. On the other hand, there is provided a modified ferris wheel assembly 264 which differs only in that instead of there being two arms 128 in each set of arms, there will be four such arms as is clearly shown in FIG. 11. Thus there will be two suction heads 130 engaging each of the lids L′.

The merry-go-round assembly 32 will remain the same except that the lid carriers 216 have been replaced by lid carriers 266 which are particularly configurated for receiving two of the lids L′.

Of course, the carton closing machine 24 will also be modified so as to simultaneously close two cartons for which the lids L′ are specifically provided.

Reference is now made to FIGS. 2 and 8 wherein there is shown that overlying the path of an innermost portion of a lid carrier 216 at the time a lid is being transferred thereto is a lid stripper along which an outer end of a respective arm 128 is passed so as to most specifically strip a neck portion of a respective lid L from its associated suction head 130. As is clearly shown in FIGS. 2 and 8, the lid stripper 256 is formed of wire and has a reversely turned, upwardly sloping end portion 258.

Although only a preferred embodiment of the lid transfer mechanism has been specifically illustrated and described herein, it is to be understood that minor variations may be made in the lid transfer mechanism without departing from the spirit and scope of the invention as defined by the appended claims.

We claim:

1. A carton lid transfer assembly for transferring lids from a magazine to a carton closing machine, said assembly conprising a ferris wheel arrangement for receiving lids from a magazine, and a merry-go-round arrangement for receiving lids from said ferris wheel assembly and presenting lids to a carton closing machine.

2. A carton lid transfer assembly according to claim 1 together with an oscillating lid picker for picking lids from a magazine for reception by said ferris wheel assembly.

3. A carton lid transfer assembly according to claim 2 wherein said lid picker includes a pivotally mounted arm, a suction cup carried by said arm, a control link for actuating said arm, and an eccentric for positioning said control link.

4. A carton lid transfer assembly according to claim 2 wherein said ferris wheel assembly includes a plurality of stations, and there are drive means between said ferris wheel assembly and said lid picker for presenting said lid picker to a magazine a number of times for each resolution of said ferris wheel assembly equal to the number of ferris wheel stations.

5. A carton lid transfer assembly according to claim 2 wherein said lid picker includes a housing, a shaft mounted within said housing for rotation, and said eccentric being carried by said shaft for rotation with said shaft.

6. A carton lid transfer assembly according to claim 5 wherein there is a rotary valve carried by said shaft within said housing for selectively connecting a vacuum source and a pressure source to said suction cup.

7. A carton lid transfer assembly according to claim 2 wherein said ferris wheel assembly includes a fixed support, a shaft rotatably journalled relative to said fixed support, a support housing carried by said shaft for rotation with said shaft, a plurality of radiating arms carried by said support housing for rotation, and a suction head carried by each arm for receiving a carton lid from said lid picker.

8. A carton lid transfer assembly according to claim 7 wherein there is carried by said shaft in association with said fixed housing and said support housing a rotary valve for selectively connecting each suction head to a vacuum source.

9. A carton lid transfer assembly according to claim 1 wherein there are stripper means between said ferris wheel assembly and said merry-go-round assembly for assuring stripping of carton lids from said ferris wheel assembly onto said merry-go-round assembly.

10. A carton lid transfer assembly according to claim 1 wherein said merry-go-round assembly includes a fixed vertical housing, a vertical shaft rotatably journalled in said housing, a rotating head carried by said shaft, a support plate carried by said housing, said support plate having a cam track, a plurality of control plates overlying said support plate, each of said control plates having a cam follower seated in said cam track for angularly positioning each control plate as each control plate moves along the cam track, an arm for each control plate extending radially from said rotating head and pivotally connected to a respective control plate for rotating said control plates, and a carton lid carrier mounted on each control plate for positioning and rotating with said control plates.

11. A carton lid transfer assembly according to claim 10 wherein each of said arms include extensible telescoped sections for effecting pivoting and positioning of a respective control plate in accordance with the spacing of said cam track from said shaft.

12. A carton lid transfer assembly according to claim 11 wherein said arm sections are resiliently urged apart to constantly urge the pivotal connection between each of said arms and a respective one of said control plates radially outwardly to effect the positioning of each of said control plates in cooperation with said cam track.

13. A carton lid transfer assembly according to claim 10 wherein said cam track has a straight portion adjacent said ferris wheel assembly to effect movement of said carriers in a straight line path at the time a carton lid is being transferred from said ferris wheel assembly to said carriers.

14. A carton lid transfer assembly according to claim 13 wherein there are guide rollers carried by said support plate adjacent said cam track straight portion for engagement by said control plates to further effect movement of said control plates and carriers in said straight line path.

15. A carton transfer assembly according to claim 10 wherein each of said control plates has interlocking means for interlocking with a carton closing machine for assuring timing of presentation of lids to a carton closing machine and orientation of lids being transferred.

16. A carton lid transfer assembly according to claim 15 wherein each of said carriers has upstanding locator elements for locating a lid on a carrier, said locating elements including resiliently mounted upstanding pins.

17. A merry-go-round assembly for delivering carton lids to a carton closing machine, said merry-go-round assembly comprising a fixed vertical housing, a vertical shaft rotatably journalled in said housing, a rotating head carried by said shaft, a support plate carried by said housing, said support plate having a cam track, a plurality of control plates overlying said support plate, each of said control plates having a cam follower seated in said cam track for angularly positioning each control plate as each control plate moves along cam track, an arm for each control plate extending radially from said rotating head and pivotally connected to a respective control plate for rotating said control plates, and a carton lid carrier mounted on each control plate for pivoting and rotating with said control plates.

18. A carton lid transfer assembly according to claim 17 wherein each of said arms include extensible telescoped sections for effecting pivoting and positioning of a respective control plate in accordance with the spacing of said cam track from said shaft.

19. A carton transfer assembly according to claim 17 wherein each of said control plates has interlocking means for interlocking with a carton closing machine for assuring timing of presentation of lids to a carton closing machine and orientation of lids being transferred.

20. A carton lid transfer assembly according to claim 1 wherein said assembly is particularly constructed to transfer two lids at a time.

* * * * *